United States Patent [19]

Futcher

[11] Patent Number: 4,744,156

[45] Date of Patent: May 17, 1988

[54] DRIER FELTING ARRANGEMENT

[75] Inventor: Ralph J. Futcher, Beaconsfield, Canada

[73] Assignee: Valmet-Dominion Inc., Lachine, Canada

[21] Appl. No.: 13,019

[22] Filed: Feb. 9, 1987

Related U.S. Application Data

[62] Division of Ser. No. 802,728, Nov. 29, 1985, Pat. No. 4,677,762.

[30] Foreign Application Priority Data

Dec. 10, 1984 [CA] Canada ..... 470741

[51] Int. Cl.[4] ..... F26B 13/08

[52] U.S. Cl. ..... 34/114; 34/116; 34/117; 34/120

[58] Field of Search ..... 34/116, 123, 114, 117, 34/120; 162/202, 207, 306; 226/95

[56] References Cited

U.S. PATENT DOCUMENTS

| | | | |
|---|---|---|---|
| 1,656,852 | 1/1928 | Bean . | |
| 3,293,767 | 12/1966 | Means | 34/116 |
| 3,303,576 | 2/1967 | Sisson . | |
| 3,868,780 | 3/1975 | Soininen et al. . | |
| 4,359,827 | 11/1982 | Thomas . | |
| 4,359,828 | 11/1982 | Thomas . | |
| 4,441,263 | 4/1984 | Vendenpaa . | |
| 4,483,083 | 11/1984 | Chance . | |
| 4,551,203 | 11/1985 | Eskelinen . | |

FOREIGN PATENT DOCUMENTS

| | | |
|---|---|---|
| 309086 | 3/1931 | Canada . |
| 1120259 | 3/1982 | Canada . |
| 1171650 | 7/1984 | Canada . |

*Primary Examiner*—Larry I. Schwartz
*Attorney, Agent, or Firm*—Raymond A. Eckersley

[57] ABSTRACT

A web drier wherein the fabric carries the web to be dried around a plurality of drier drums in a sequence with at least one turning roll positioned between each roll in the sequence so that the web carried on the fabric is in direct face-to-face contact with each of the drums. The fabric is in face-to-face contact with each of the rolls between the drums and the web is held to the fabric by suction applied by blow boxes appropriately located relative to each turning roll. The rolls may be arranged in stacks with there being two turning rolls between adjacent stacks at one end of the stacks and none at the other. This arrangement improves the drying capacity of the drier by insuring that the web is in direct contact with the heated surface of the drier drums and may be used with existing 2-tier drier drum arrangements or with drums stacked higher or even as a single row of drums.

1 Claim, 2 Drawing Sheets

DRIER FELTING ARRANGEMENT

This application is a division of application Ser. No. 802,728, filed Nov. 29, 1985, now U.S. Pat. No. 4,677,762.

FIELD OF THE INVENTION

The present invention relates to a drier drum fabric arrangement. More particularly the present invention relates to a drier drum fabric arrangement wherein the web being dried is carried on a single fabric and is maintained in direct face-to-face contact with a plurality of drier drums in a sequence and is held to turning rolls between the drums by suction generated by blow boxes.

BACKGROUND OF THE PRESENT INVENTION

Generally in the manufacture of paper, a web of paper is formed on a drainage wire and passed through a plurality of press rolls whereon further water is extracted and then onto heated drier drums. In modern high speed machines use of open draws wherein the web is unsupported over short spans through the system are avoided, of possible, at least until such time as the web strength is sufficient to reduce the possiblity of web breakage to a minimum. Preferably a web will be continuously supported through the machine to even better insure against the possibility of a breakage.

In the drier section the web is generally carried by a pair of felts, one felt wrapping the upper drums of the drier section and the second felt wrapping the lower drums of the drier section with the web passing back and forth between upper and lower drums and being transferred from the upper felt to the lower felt as it passes up and down over the various drums. In this manner the web is maintained in direct contact with both the upper and lower drier drums i.e. between the upper felt and and the peripheral surface of the upper drums and between the lower felt and the peripheral surface of the lower drums.

Obviously, this system results in a significant number of transfers since the web travels back and forth between the upper and lower drums and must transfer back and forth between the upper and the lower felts between each roll of the sequence with such transfers normally being in the form of open draws.

It is also known, particularly in the first drier section immediately following the press section of the paper machine, to utilize a single felt to carry the web through the first section until it increases in dryness and in strength so that the odds of a breakage are significantly reduced. However, when the web is carried on a single felt if it is sandwiched between the felt and the outer surface of the top drums it will be on the outside of the lower drums or vice versa. Thus on the drums where the web is outside, the drying efficiency is relatively low since the felt is introduced between the hot drier drum surface and the web to be dried and acts as an insulator. Furthermore there are problems in carrying the web around the drier drum when the web is on the outside of the felt and special means should be provided to insure that separation does not occur or alternatively the drier, and thus the paper machine, must be operated at a relatively low speed which defeats the purpose of the concept.

One arrangement wherein the web is carried on a single felt through the drier section is shown in Canadian Patent No. 1,120,259 issued Mar. 23, 1982, Kankaapaa. In this arrangement the web travels with the felt 20 around a plurality of drier drums and is sandwiched between the felt and the drier drum on alternate drums and is on the outside of the felt on the intermediate drums. Suitable means such as a top felt may be used to hold the web against the carrying felt on the intermediate drums.

It is also known to use blow boxes employing Coanda nozzles to cause flow along the surface thereof and to induce a negative pressure allowing one side of the felt in the drier section. This technique is used to maintain contact between the web and the drier felt to permit higher speed operation by preventing or reducing the air entrainment with the felt and reducing the pumping effect of the drum so that the web tends to stay on the felt when traversing drums equivalent to the intermediate drums described hereinabove, i.e., where the felt is sandwiched between the web and the drier drum. It is also known to use suction boxes for a similar purpose as taught for example in Canadian Patent No. 1,171,650, issued July 31, 1984 to Veddenpaa and in U.S. Pat. Nos. 4,359,827 and 4,359,828 issued Nov. 23, 1982 to Thomas.

Some papers mills are drier limited. In other words the drying capacity of the drier drums is what limits the maximum speed of the machine and thus if some means could be provided for increasing the drier capacity the machine could operate at higher speed and increased production. Generally such an increase in capacity can only be obtained by adding a drier drum between the presses and the first drier, for example in the form of a baby drier drum however due to the restriction in space little extra drying capacity can be provided. While such an addition could increase slightly the drying capacity of the equipment it does not permit a major improvement in speed. In many such driers there is sufficient space above the drier to accommodate further drums however the threading technique utilized in conventional felt wraps does not lend itself to stacking drier drums more than the conventional two-high arrangement.

The concept of carrying a web through a drier section on a single felt and providing turning rolls therebetween so that the web being dried is always in contact with the surface of the drier drum, i.e., between the felt and the drier drum has been known for many years, as shown for example, in Canadian Patent No. 309,086, issued Mar. 3, 1931 to Vedder. In the particular concept illustrated in this patent the web being dried is separated from the felt between each of the drier drums in the sequence so that the felt takes one path and the web being dried another path spaced from the felt between each of the drier drums.

It has also been proposed to carry the web on the felt around the turning roll so that the felt and web travel together through the various nips with the felt always on the outside trapping the web between the drier drum and itself. In this particular concept the felt travels from the bottom of one stack to the top of the next adjacent stack so that the felt travel is down one stack, up to the top of the next and then down the following stack in order to permit broke removal.

As far as Applicant is aware neither of the above arrangements for carrying the web in contact with each of the drier drums in the sequence has been used to date. The earlier concept as described in Canadian Patent No. 309,086 clearly has a feeding problem, a broke disposal problem and is limited to very low speeds whereas the more recent arrangement would probably permit broke disposal but limits severely the speed at which the drier may be operated since the web will not stay with the felt as it traverses the turning rolls at high speed.

BRIEF DESCRIPTION OF THE PRESENT INVENTION

It is an object of the present invention to provide a drier felt run wherein a single drier felt carries the web to be dried over a plurality of drier drums in succession with the web trapped between the felt and the drum surface thereby to improve the heat transfer and reduce opportunity for breakage in the drier and including blow boxes to hold the web to the felt when the web is outside of the felt as it travels over turning rolls interposed between the drier drums.

It is a further object of the present invention to provide a system wherein drier drums may be stacked or positioned in any suitable manner to permit increased drying capacity by addition of drier rolls above or below the conventional drier drum stand.

It is also an object of the present invention wherein the length of the space available may be used to provide increased drying capacity by a vertical arrangement of three or more drier drums stacked one above the other.

Broadly the present invention relates to a drier drum felt arrangement comprising a plurality of drier drums having outer drying peripheries around which the felt is trained said felt passing around each of said drier drums in succession, at least one turning roll between each successive drum in said succession, one surface of said felt forming a web receiving surface onto which a web to be dried is positioned, said one surface of said felt travelling around each of said drums in succession facing the outer periphery of said drums throughout the wrap of each said drum by said felt and the opposite surface of said felt riding in face-to-face relationship with the periphery of said turning rolls between said drums whereby the web carried on said one surface is sandwiched between said felt and each of said drier drums in said sequence, a blow box provided adjacent and on the incoming side of each of the turning rolls, each said blow box having a working surface adjacent said opposite face of said felt as said felt approaches said roll, each of said blow boxes including a Coanda nozzle directing air flow along said working surface and moving in a direction away from turning roll adjacent which it is located thereby to provide a reduced pressure in the nip between the felt and the turning roll and retain said web on said felt.

The blow box positioned on the incoming side of the turning roll reduces the amount of air that may be entrained into the nip between the turning roll and the felt but in many cases a box working surface may be provided adjacent both the oncoming and offgoing sides of the turning roll.

Preferably the turning rolls will be grooved so that a negative pressure is maintained substantially around the turning roll to hold the web on the felt as the web and felt traverse the turning roll.

In the arrangement described the drier drums are arranged in stacks with the felt passing around the drums of a first stack until the last drum in the stack and then passing from said last drum in the first stack to the adjacent drum in a second stack and around all of the drums in the second stack to the opposite end of the second stack from whence the felt may travel to the adjacent drum of a third stack.

Preferably the turning rolls positioned between adjacent drums will be so positioned that in the event of a break, broke can travel from the turning roll or drums in a path that will permit flow of broke to the broke pit therebelow.

BRIEF DESCRIPTION OF THE DRAWINGS

Further features, objects and advantages will be evident from the following detailed description of the embodiments of the present invention taken in conjunction with the accompanying drawings in which.

DESCRIPTION OF THE PREFERRED EMBODIMENTS

Figure 1:
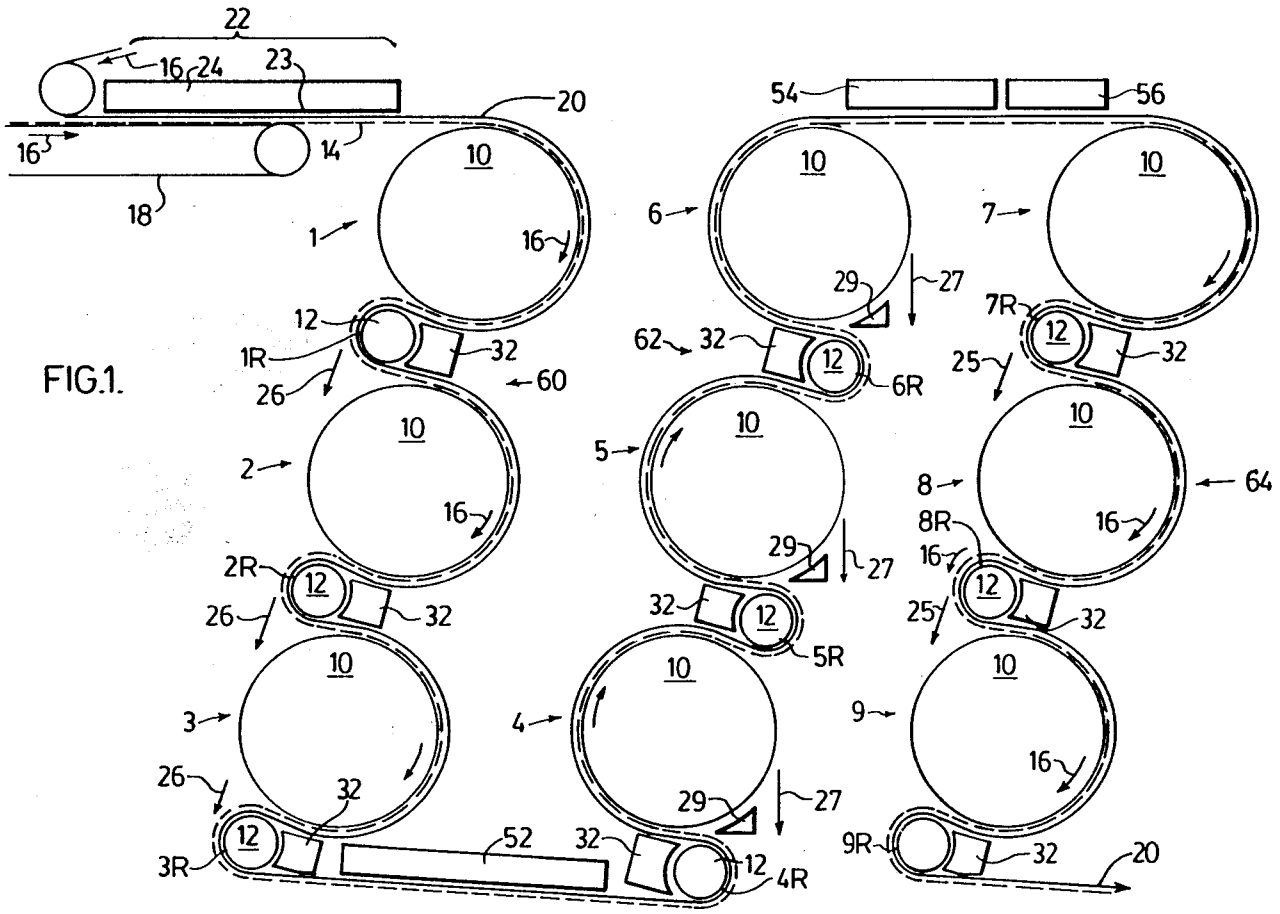
FIG. 1 is a schematic side elevation view illustrating one arrangement of the present invention.

Throughout the views all of the drier drums or cans have been indicated by the reference numeral 10, all of the turning rolls by numeral 12, the web 14 by a dash line and the various felts such as the main felt 20 by a solid line. It will be noted that the turning rolls 12 have significantly smaller radius relative to the drier drums and therefore the problem of holding the web 14 to the felt such as felt 20 is much more severe than is encountered when the web is outside of the felt in the conventional single felted arrangement described above.

The term felt as used throughout the disclosure is used in its broadest sense to include any type of suitable drier fabric.

As shown in FIG. 1 the web 14 is moving in the direction of the arrows 16 on a first felt 18 and is transferred onto a second felt 20 in the transfer zone 22. In this zone a suitable blow box 24 is provided on the back side of the felt i.e. the side of the felt opposite to that on which the web 14 is to be transferred. This blow box 24 creates flow fo air between the felt and the working surface 23 of the box by means of one or more Coanda type nozzles to thereby induce a negative pressure on the adjacent side of the felt 20 to transfer the web 14 to the felt 20. The blow box will be described in more detail hereinbelow and is the preferred system for developing the required negative pressure, but alternatively any suitable means for creating a low pressure behind the felt 20 to cause the web 14 to adhere to the felt 20 may be used.

The felt 20 carries the web 14 onto the periphery of the first drier drum 10 indicated by the number 1 with the web 14 sandwiched between the felt 20 and the outer periphery of the drum. The web is carried off of the drum on the upwardly facing side of the felt 20 and over a first turning roll 12 indicated by number 1R and travels around this turning roll number 1R with the felt 20 sandwiched betwen the roll 12 and the web 14. The web 14 and felt 20 pass over each of the drier drums 10 indicated in the sequence in which they are traversed by reference numerals 1, 2, 3, - 9 and the turning rolls 12 indicated also in the sequence in which they are traversed by references 1R, 2R, 3R - - - 9R. It will be clear that the web 14 is always sandwiched between the periphery of the drum 10 and the felt 20 whereas as the web and felt traverse each of the turning rolls 12 in the sequence the felt is sandwiched between the web and the turning roll.

The turning rolls in the sequence 1R, 2R and 3R are positioned and rotate in a direction so that any broke will spill off of the rolls such as rolls 1R or 2R and as indicated by the arrows 26 will travel in a path over the rolls therebelow i.e., broke falling off 1R will pass the roll 2R and 3R and similarly broke falling off of roll 2R will pass over the roll 3R to the broke pit.

It will further be noted that a similar arrangement of the turning roll 7R, 8R and 9R permits the free fall of broke as indicted by the arrows 25 and the broke falling from the drums 4, 5 and 6 will clear all of the rolls therebelow and follow the paths of the arrows 27 to the broke pit (not shown) below the machine. If desired suitable doctors such as illustrated at 29 may be provided to clear the broke from the drums as indicated for drums 4, 5 and 6.

Care must be taken to ensure that the web 14 does not fly off of the felt 20 where it is exposed i.e. on the outside of the rolls 12 which are the points at which there is a greatest likelihood of separation.

Figure 3:
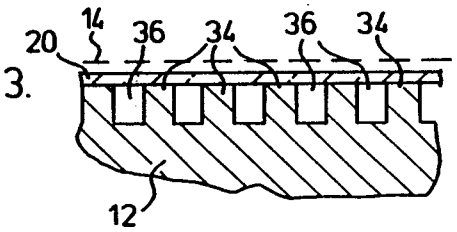
FIG. 3 is a partial section along the lines of 3—3 of FIG. 2.

The web is held onto the felt 20 as the felt and web traverse a turning roll 12 by means of a blow box schematically indicated at 32 in the various figures. These blow boxes 32 are preferably used in combination with grooved rolls such as those indicated in FIGS. 2 and 3 so as to maintain a reduced pressure around the periphery of the turning rolls 12. The specific shape of the blow boxes 32 will match with the shape of the area in which it is being used and preferably will apply suction on both the onrunning and offrunning sides of each of the rolls 12 although as will be apparent the blow box need only function on the onrunning side of each roll 12.

Figure 2:
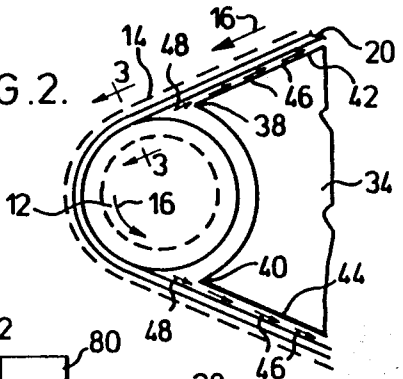
FIG. 2 is a enlarged view illustrating a preferred form of blow box and turning roll to retain the web on the felt as they traverse the turning roll.

Referring to FIG. 2 the felt 20 carrying the web 14 is shown moving in the direction of the arrow 16 around the turning roll 12. It will be noted that the surface of the turning roll 12 is made up of a plurality of alternating lands 34 and grooves 36 extending peripherally around the roll 12. The blow box schematically indicated at 32 is provided with a pair of Coanda nozzles generally indicated at 38 and 40. Each of these Coanda nozzles 38 and 40 direct air flow out of the box 32 to curve and flow along the working surfaces 42 and 44 respectively on the blow box 32 and cause air to flow between the surfaces 42 and 44 and the adjacent reaches of the felt 20. As indicated by arrows 46 this flow of air is relatively rapid and tends to induce air to flow from the grooves 36 in the roll 12 as indicated by the arrows 48 and also to induce air flow through the felt 20 by the induced negative pressure obtained by the rapid flow in the direction of the arrows 46. This negative pressure obviously holds the web 14 against the felt 20 over the whole zone where the negative pressure is applied. If the unsupported reach is too long further such blow boxes may be applied. For example as indicted by the blow boxes 52, 54, 56 and 58 which are positioned as required in FIG. 1.

It will also be apparent that the suction device 24 may in fact be a blow box equivalent to the blow boxes 52 or 54 etc.

The blow boxes provide air flow between the felt and the surface of the box which eliminates any drag forces that might be applied for example if a suction box were used and thereby reduces significantly the amount of wear on the felts.

The blow boxes 32 have been shown as having two surfaces 42, and 44 adjacent the oncoming and offgoing felt runs respectively of the roll 12 in FIG. 2. This is the preferred arrangement, but it is only essential to have a working face equivalent to surface 42 adjacent the oncoming side of the roll 12.

In summary it will be noted that on each of the drums 10 the web 14 is always sandwiched between the felt 20 and the outer hot surface of the drum 10 whereas on each of the turning rolls 12 the felt 20 is sandwiched between the web 14 and the outer surface of the turning roll 12 so that the heated surface of the drum is in its best strategic location to apply heat to the web 14 and the web 14 is continuously supported by the single felt.

In the arrangement shown in FIG. 1 a modified dryer having drums stacked three high has been shown i.e. drums 1, 2 and 3 forming a first stack 60; drums 4, 5 and 6, a second stack 62 and drums 7, 8 and 9, a third stack 64 etc. It will be apparent that the nubmer of drums in a vertical stack may be as many as desired when the principles of the present invention are used. This permits expansion of an existing drier section vertically to provide increased drying capacity or the construction of a drier that is relatively tall yet not so long as was heretofore necessary.

It is important that the felt pass from the end of one stack, say stack 60, to the adjacent end of the adjacent stack 62. In the illustrated arrangement felt travels from drum 3 to drum 4 which are the two bottom drums in the stacks 60 and 62 and from the drum 6 to the drum 7 which are the top drums in the stacks 62 and 64, thus the felt and web travel from the drum at one end of a first stack 62 to the adjacent drum at the same end of another stack along the second stack to the opposite end thereof and from the opposite end of the second stack to the adjacent end of a third stack 64.

Figure 4:
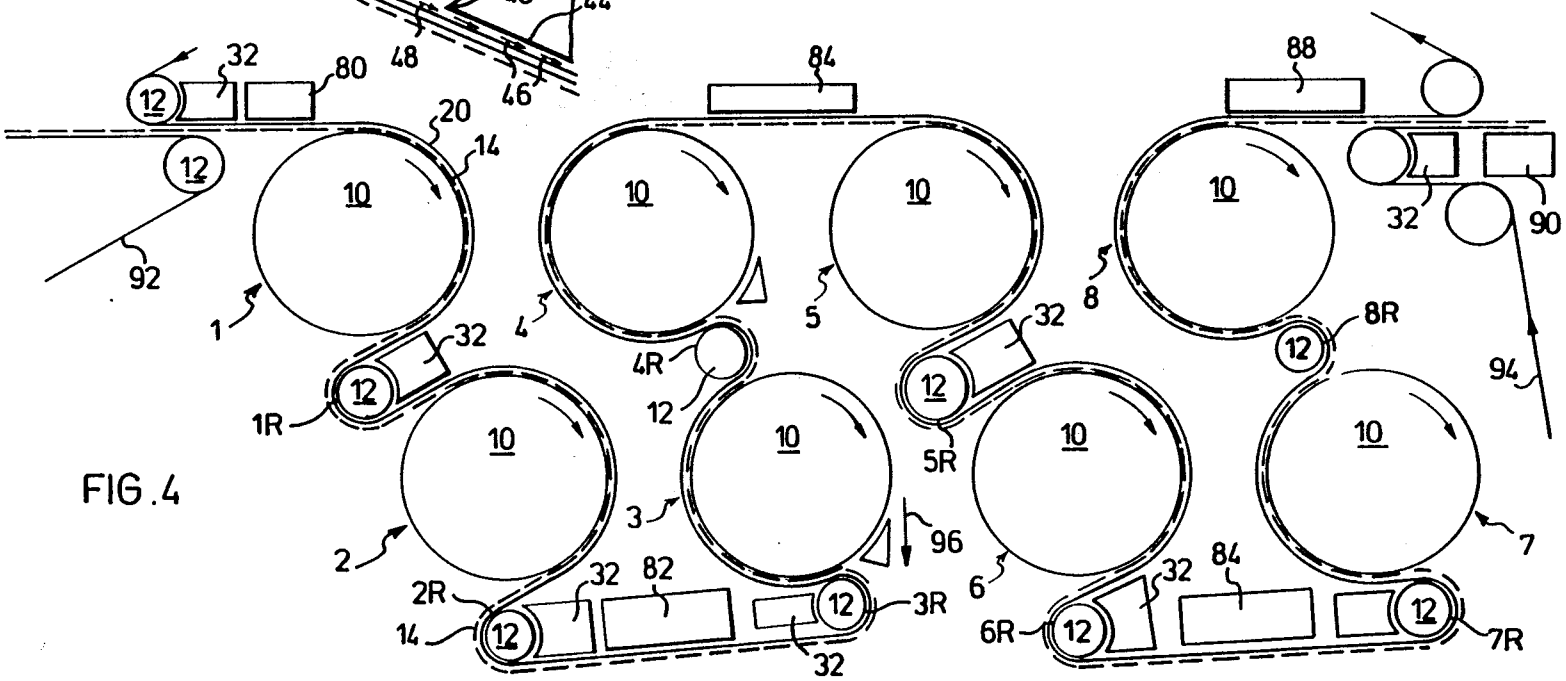
FIG. 4 illustrates a further example of an arrangement incorporating the present invention.

FIG. 4 simply shows a slightly modified arrangement with the blow boxes 32 appropriately located and supplemental blow boxes 80, 82, 84, 86, 88, and 90 appropriately located with the blow box 80 functioning to aid in the transfer from the oncoming felt indicated at 92 onto the major felt 20 and the blow boxes 90 together with its adjacent blow box 32 functioning to transfer the web 14 from the felt 20 onto a trailing belt 94 to be carried over a further sequence of drier drums 10 not shown.

It will be noted in the FIG. 4 embodiment that broke unsupported by the felt 20 can only escape from the system at rolls 1R and 2R in the first stack and can fall directly to the broke pit. Broke unsupported in the second stack formed by drums No. 3 and 4 is rejected from the surface of these drums number 3 and 4 to fall from drum number 4 to drum number 3, from drum number 3 as indicated by the arrow 96 into the broke pit therebelow. A similar sequence as described above with repsect to rolls 1R and 2R in FIG. 4 occurs at rolls 5R and 6R while drum 7 and 8 dump broke in the same manner as drums 3 and 4. The drums such as drums 3 and 4 have been shown laid out in a conventional manner.

It will be apparent that in all of the arrangements illustrated the web 14 is always held between the felt 20 and the surface of the drier drum and always rides on the outside of the felt as the felt travels around the turning rolls 12.

With this arrangement it will be apparent that maximum heat transfer obtainable from each of the drier drums due to the direct contact between the drier drums and the web is obtainable.

The drums have been shown stacked in the conventional manner for example in a 2-tier height (stacked 2 high) in FIG. 4 and in a modified fashion 3-tier high in FIG. 1, but it will be apparent that the number of tiers may be increased or decreased. For example a single tier or line of drums may be used with the felt sandwiching the web against each drum and blow boxes used to hold the web to the felt as the intermediate turning rolls are transversed or 4 or more tiers may be used with arrangements such as that shown in FIG. 1.

Obviously suitable drive arrangements must be provided for driving the driers and felts in known manner for examle by driving some of the drums and/or turning rolls and thereby through the felt driving the remaining rolls and drums traversed by the felt. It will be noted that the rotation of the rolls is different than with a conventional 2-tier arrangement so that on a rebuild the existing drive may require revision.

Having described the invention, modifications will be apparent to those skilled in the art without departing from the spirit of the invention as defined in the appended claims.

What I claim as new and desire to secure by Letters Patent of the United States of America is:

1. A web transfer between a pair of felts comprising a first felt and a second felt, a web to be transferred from the first felt to the second felt, a transfer zone wherein said felts are in substantially parallel and face-to-face relationship supporting a web therebetween, said transfer zone being free of any means other than the two felts for the transfer of the web from the first felt to the second felt, the web to be transferred being initially carried on an outer surface of said first felt, a blow box having a working surface located adjacent an inner face of said second felt to direct flow of air along the working surface of said blow box adjacent said inner face of said second felt thereby to reduce the pressure adjacent said inner face and induce flow of air through said second felt to apply suction forces to said web and to adhere said web to said second felt thereby effecting transfer of said web from said first felt to said second felt.

* * * * *